US009907409B2

(12) United States Patent
Leng

(10) Patent No.: US 9,907,409 B2
(45) Date of Patent: Mar. 6, 2018

(54) BUNK BED EQUIPPED WITH GUARD RAIL

(71) Applicant: NEW-TEC INTEGRATION (XIAMEN) CO., LTD., Xiamen, Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 15/521,745

(22) PCT Filed: Oct. 23, 2015

(86) PCT No.: PCT/CN2015/092685

§ 371 (c)(1),
(2) Date: Apr. 25, 2017

(87) PCT Pub. No.: WO2016/066061

PCT Pub. Date: May 6, 2016

(65) Prior Publication Data

US 2017/0245650 A1 Aug. 31, 2017

(30) Foreign Application Priority Data

Oct. 29, 2014 (CN) ..... 2014 2 0637735 U

(51) Int. Cl.
*A47C 21/08* (2006.01)
*A47C 19/20* (2006.01)

(52) U.S. Cl.
CPC ..... *A47C 21/08* (2013.01); *A47C 19/20* (2013.01)

(58) Field of Classification Search
CPC ..... A47C 21/08
USPC ..... 5/9.1, 425–430
See application file for complete search history.

(56) References Cited

U.S. PATENT DOCUMENTS 5,596,776 A * 1/1997 Huang ..... A47C 21/08 403/263
7,051,384 B1 * 5/2006 Guillot ..... A47C 17/50 5/425

FOREIGN PATENT DOCUMENTS

| | | | |
|---|---|---|---|
| CN | 201422657 | Y | 3/2010 |
| CN | 201905562 | U | 7/2011 |
| CN | 203073880 | U | 7/2013 |
| CN | 203914168 | U | 11/2014 |
| CN | 204245691 | U | 4/2015 |
| JP | 2005334511 | A | 12/2005 |
| JP | 2007117441 | A | 5/2007 |

(Continued)

*Primary Examiner* — Fredrick C Conley
(74) *Attorney, Agent, or Firm* — Rabin & Berdo, P.C.

(57) ABSTRACT

A bunk bed equipped with a guard rail, has a bed board frame, two side bed frames respectively disposed at the front and rear sides of the bed board frame to support the bed board frame and a guard rail disposed at the side of the bed board frame. The guard rail includes a first rail frame, a second rail frame and a rotating mechanism. The rotating mechanism connects the first rail frame and the second rail frame, such that the two rail frames rotate relatively in the horizontal direction or the longitudinal direction. The first rail frame is locked to the second rail frame by a lock mechanism to form a guard rail entirety. The rotating mechanism moveably connects the first rail frame and the second rail frame, the first rail frame and the second rail frame are locked by a lock mechanism to form a detachable guard rail.

9 Claims, 9 Drawing Sheets

(56) References Cited

FOREIGN PATENT DOCUMENTS

JP 3191915 U 7/2014

* cited by examiner

BUNK BED EQUIPPED WITH GUARD RAIL

TECHNICAL FIELD

The present invention relates to a bunk bed, particularly to a bunk bed equipped with a guard rail.

BACKGROUND

Through the rational space utilization in the height direction, bunk beds are increasingly popular and accepted by the customers. A bunk bed usually comprises a upper bed board frame, a lower bed board frame, a ladder and two side frames.

Because the upper bed board frame is positioned relatively high, in order to prevent one falling from the upper bed board frame, guard rails are installed on both sides of the upper bed board frame. However, the existing guard rail is large in volume, making it inconvenient to transport, especially by sea, as large components result in low loading quantities per container. Products are made foldable, they can be folded for storage and transportation and unfolded for use. In this way, the volume is reduced without increasing the installation difficulty, thus the folding method is more convenient to use.

SUMMARY

The present invention relates to a bunk bed equipped with a guard rail, which overcomes the disadvantages of the existing known technology. The technical proposal of the present invention is:

A bunk bed equipped with a guard rail, comprising: a bed board frame; two side bed frames respectively disposed at a front side and a rear side of the bed board frame to support the bed board frame; and a guard rail disposed at the side of the bed board frame, the guard rail comprising a first rail frame, a second rail frame and a rotating mechanism; the rotating mechanism connecting the first rail frame and the second rail frame, the first rail frame and the second rail frame rotating relatively in the horizontal direction or the longitudinal direction; the first rail frame being locked to the second rail frame by a lock mechanism to form a complete guard rail.

In another preferred embodiment, the lock mechanism comprises two bolts and connecting holes disposed at two neighboring vertical bars of the guard rail; one bolt is used to lock an upper end of the first rail frame and an upper end of the second rail frame together, the other bolt is used to lock a bottom end of the first rail frame and a bottom end of the second rail frame together.

In another preferred embodiment, the rotating mechanism comprises at least one hinge.

In another preferred embodiment, the rotating mechanism comprises a rotating shaft and a sleeve tube, the rotating shaft and the sleeve tube are respectively disposed at the first rail frame and the second rail frame and are rotatably connected in an axial direction in an insertion relationship.

In another preferred embodiment, the guard rail further comprises a reinforcing mechanism, the reinforcing mechanism comprises a tenon and an insertion groove, the tenon and the insertion groove are respectively disposed at the first rail frame and the second rail frame and are rotatably connected in the axial direction in an insertion relationship.

In another preferred embodiment, the guard rail further comprises a reinforcing mechanism, the reinforcing mechanism comprises a J shaped bolt and a bolt hole, the bolt and the bolt hole are respectively disposed at the first rail frame and the second rail frame, the bolt is rotatably inserted in the bolt hole in the axial direction.

In another preferred embodiment, the bunk bed further comprises a ladder, the top end of the ladder is connected to the bed board frame, the guard rail is disposed at a side of the ladder.

In another preferred embodiment, the bunk further comprises a bed base frame, the side bed frames supporting the bed base frame, the bottom end of the ladder being connected to the bed base frame.

Compared to the existing known technology, the technical proposal of the present invention has following advantages:

1. The rotating mechanism moveably connects the first rail frame and the second rail frame, the first rail frame and the second rail frame are locked by a lock mechanism to form a detachable complete guard rail, the rail frames can be divided for packaging and transportation, thus increasing the container loading quantity.

2. The rotating mechanism comprises at least one hinge, the connecting of the first rail frame and the second rail frame is more stable and reliable, thus greatly improving the safety performance of the products.

3. The rotating mechanism comprises a rotating shaft and a sleeve tube, the rotating shaft and the sleeve tube are respectively disposed at the first rail frame and the second rail frame, the structure is simple, the assembly is convenient. In addition, the guard rail is formed by a plurality of tubes welding together, the tube of the guard rail can be served as the sleeve tube, which reduces the manufacturing cost.

4. The guard rail further comprises a reinforcing mechanism, the reinforcing mechanism comprises a tenon and an insertion groove, the tenon is inserted into the insertion groove in the axial direction, further enhancing the strength and the safety of the products.

BRIEF DESCRIPTION OF THE DRAWINGS

The present invention will be further described with the drawings and the embodiments.

DETAILED DESCRIPTION OF EMBODIMENTS

Figure 1:
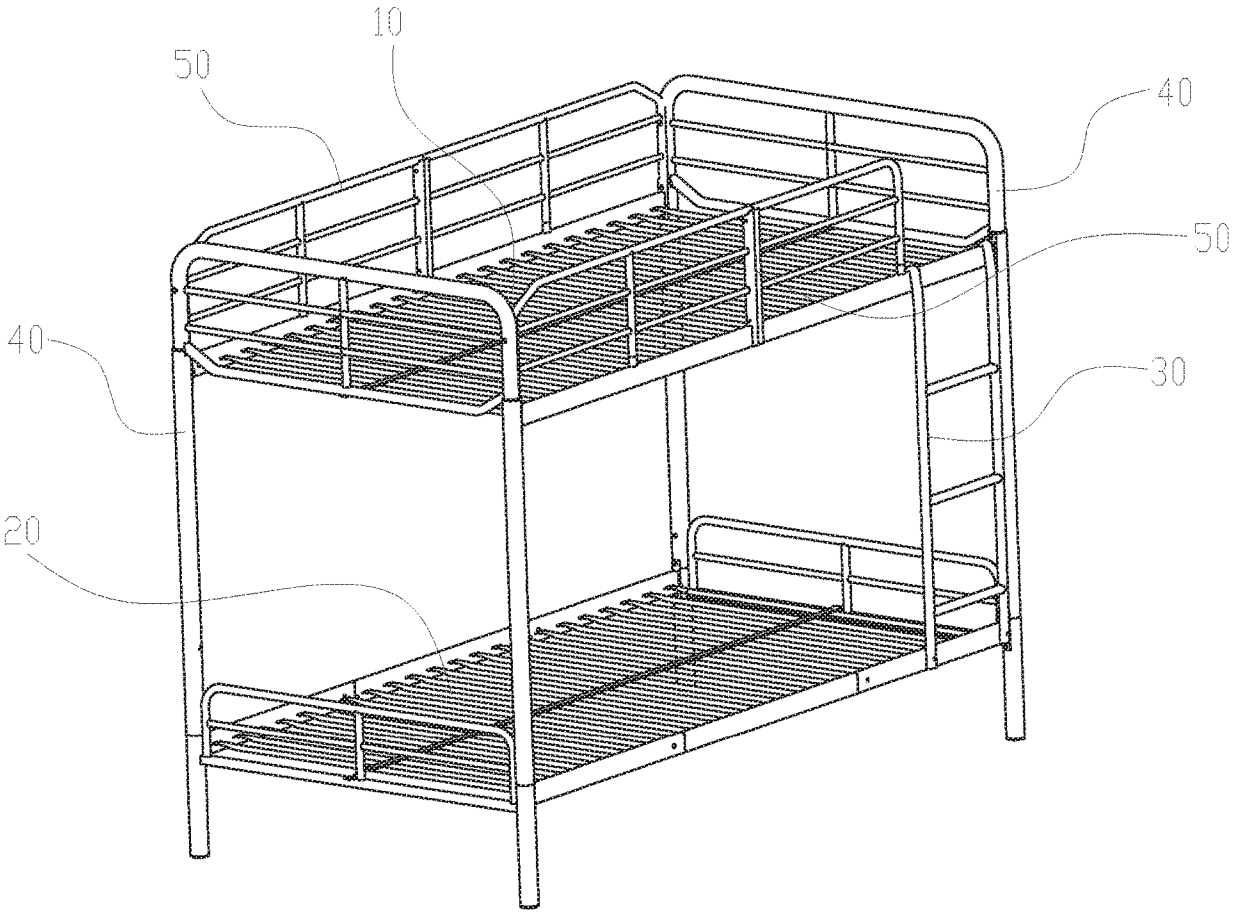
FIG. 1 illustrates a schematic diagram of a bunk bed equipped with a guard rail of the present invention.
Figure 2:
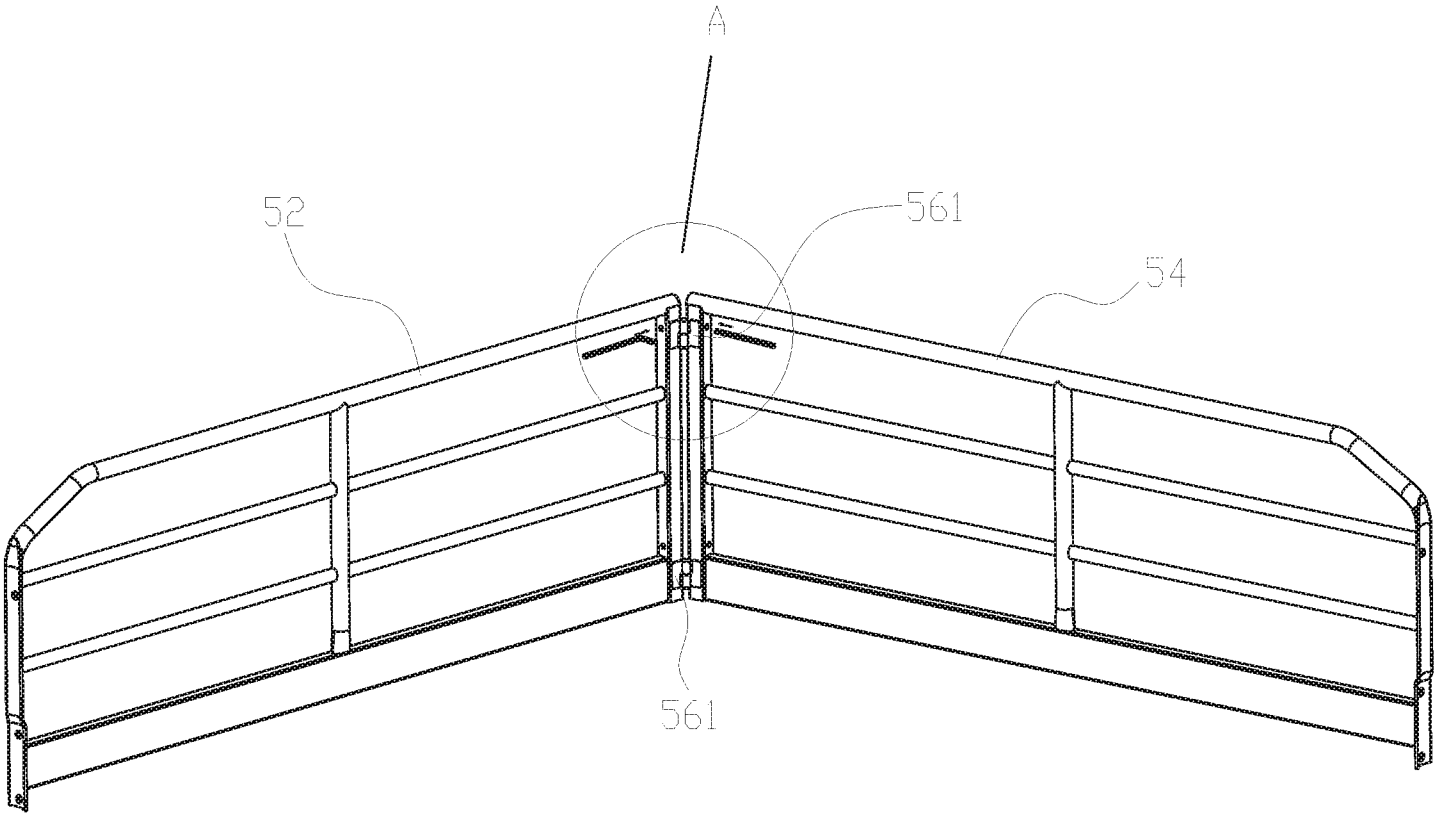
FIG. 2 illustrates a schematic diagram of a guard rail of the bunk bed of FIG. 1 in a first embodiment.
Figure 3:
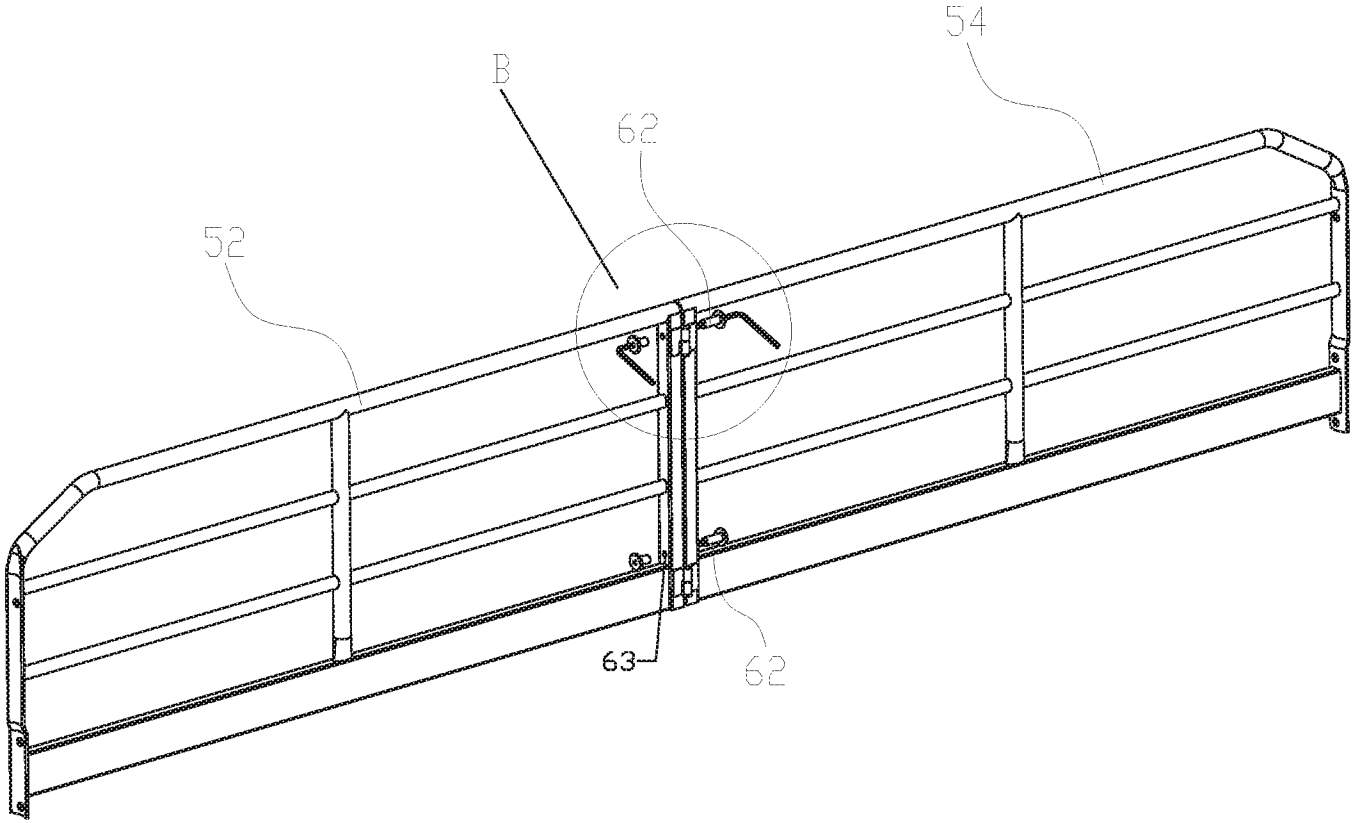
FIG. 3 illustrates a schematic diagram of a guard rail of the bunk bed of FIG. 1 in a second embodiment.
Figure 5:
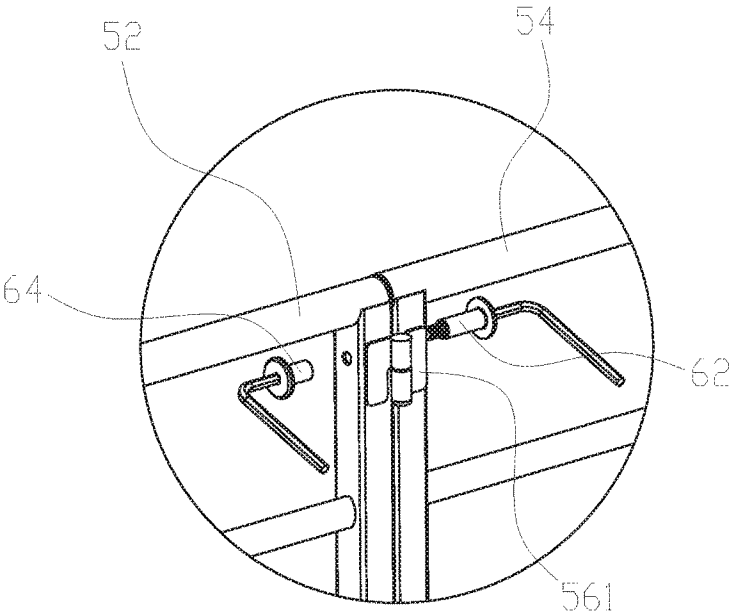
FIG. 5 illustrates an enlargement diagram of B in FIG. 3.
Figure 4:
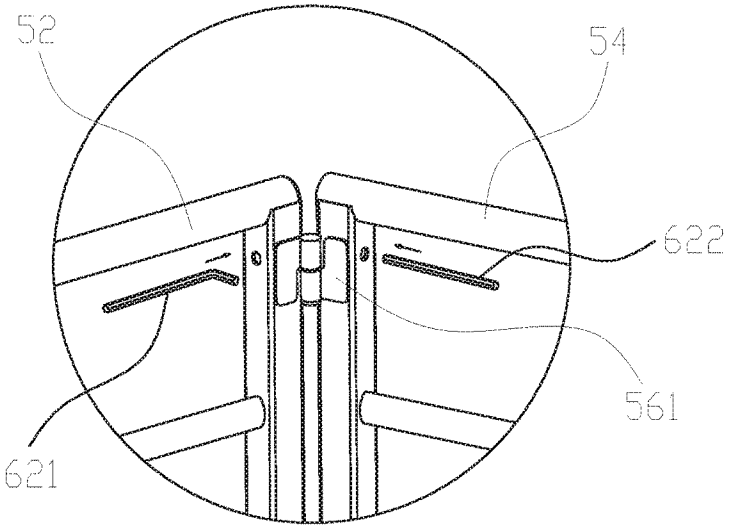
FIG. 4 illustrates an enlargement diagram of A in FIG. 2.
Figure 6:
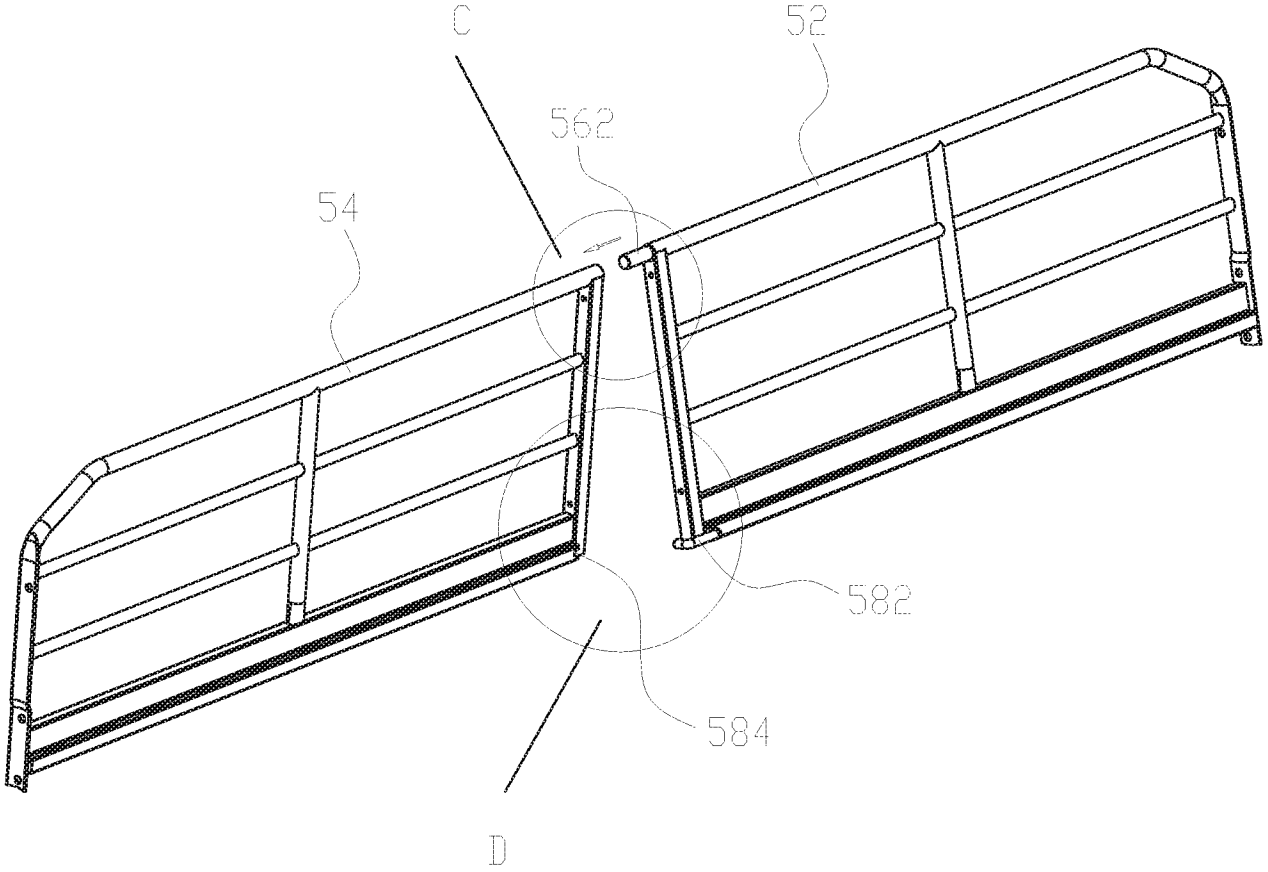
FIG. 6 illustrates an exploded schematic diagram of the guard rail of the bunk bed of FIG. 1 in the second embodiment.
Figure 7:
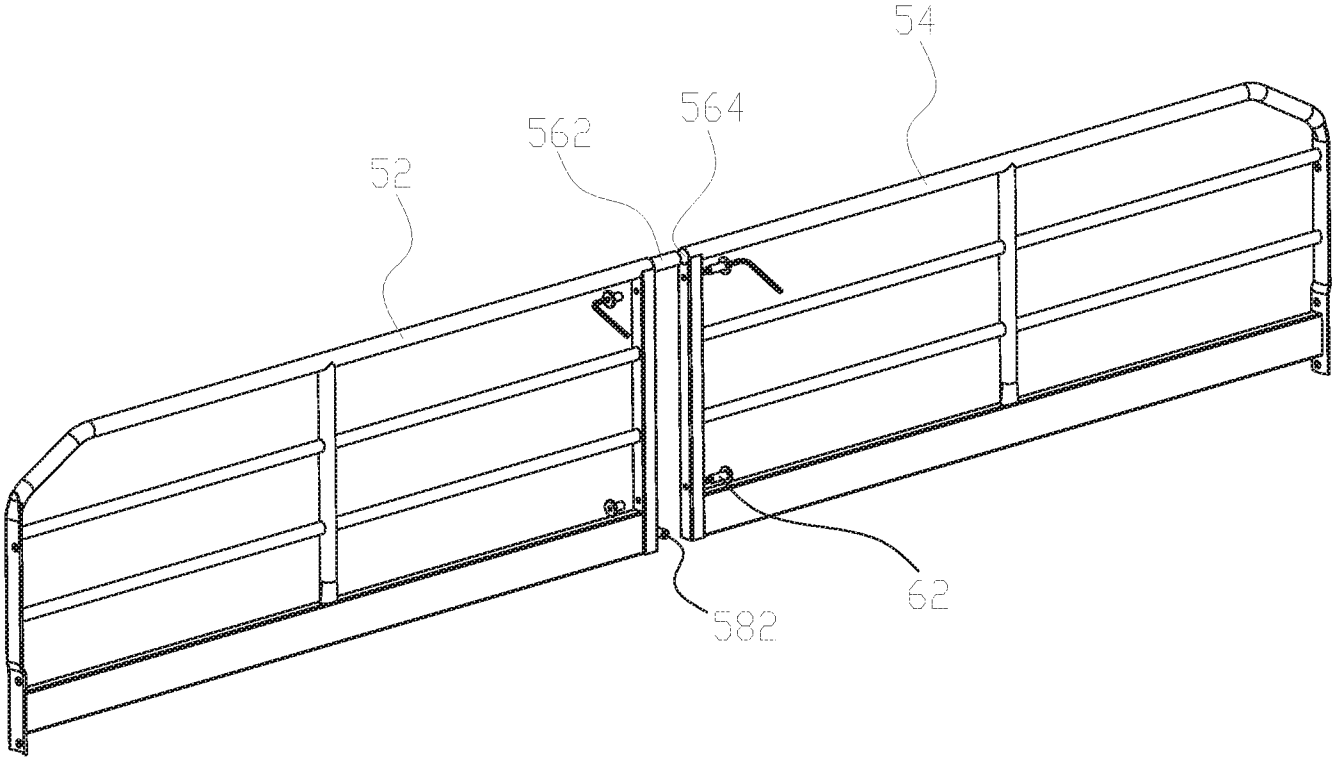
FIG. 7 illustrates another exploded schematic diagram of the guard rail of the bunk bed of FIG. 1 in the second embodiment.
Figure 9:
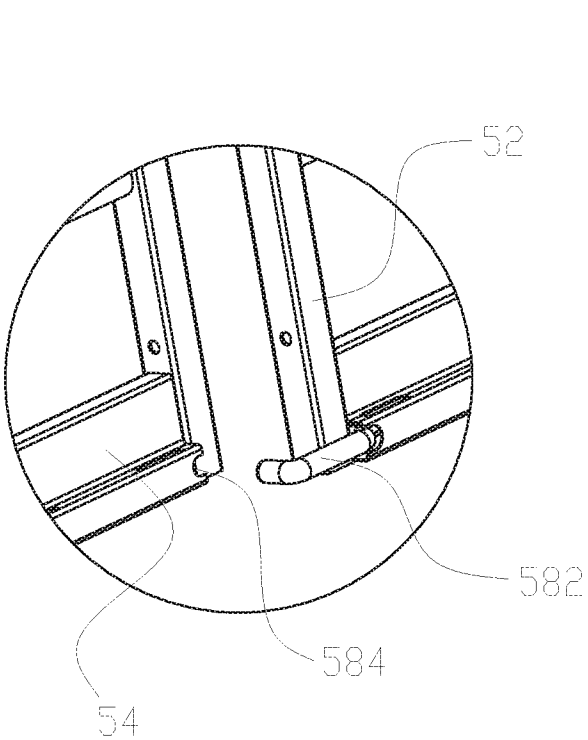
FIG. 9 illustrates an enlargement diagram of D of FIG. 6.
Figure 8:
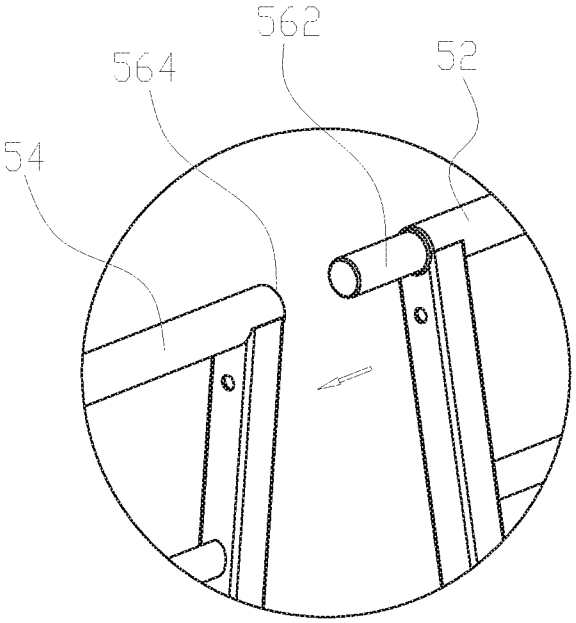
FIG. 8 illustrates an enlargement diagram of C of FIG. 6.

Referring to FIG. 1, the bunk bed equipped with a guard rail of the present invention comprises a bed board frame 10, a bed base frame 20, a ladder 30, two side bed frames 40 and two guard rails 50.

The structure of the bed board frame 10 has similar structure with the bed base frame 20. The bed board frame 10 stands above the bed base frame 20. The bed board frame 10, the bed base frame 20 respectively comprises two cross beams and a plurality of connecting rails disposed between the two cross beams. The top end of the ladder 30 is connected to the bed board frame 10, the bottom end of the ladder 30 is connected to the bed base frame 20. The two side bed frames 40 are disposed at the front and rear sides of the bed board frame 10 and the bed base frame 20. The two side bed frames 40 support the bed board frame 10 and the bed base frame 20. The two guard rails 50 are disposed at the left and right sides of the bed board frame 10. Here, the length of one guard rail 50 is less than that of the other one, for the purpose to make space for the ladder 30 and to allow the user in and out of the bed board frame 10.

A variety of structure of the guard rail 50 is possible, a detailed description of the structure of the guard rail 50 follows:

A first embodiment of the guard rail is referred to in FIGS. 2-5, the guard rail comprises a first rail frame 52, a second rail frame 54 and a rotating mechanism. The rotating mechanism comprises two hinges 561, which are rotatably connecting the first rail frame 52 and the second rail frame 54. Therefore, the two rail frames can be folded and unfolded. In addition, the first rail frame 52 is locked to the second rail frame 54 by a lock mechanism to form the complete guard rail in a plane. The lock mechanism comprises two screw bolts 62 and connecting holes 63 at the neighboring vertical bars of the guard rail. One screw bolt 62 passes through the connecting holes at the top end of the vertical bar of the first rail frame 52 and the top end of the vertical bar of the second rail frame 54, and is locked by a nut 64. The other screw bolt 62 passes through the connecting holes at the bottom end of the vertical bar of the first rail frame 52 and the bottom end of the vertical bar of the second rail frame 54, and is locked by a nut 64.

The first rail frame 52 and the second rail frame 54 may be perpendicularly locked to each other by a lock mechanism, if the screw bolt 62 is replaced by a right angled bolt, the first rail frame 52 and the second rail frame 54 are placed at a right angle, the right angled screw bolt 621 passes through the top end of the vertical bar of the first rail frame 52 and the straight section 622 passes through the connecting hole at the top end of the vertical bar of the second rail frame 54, and the right angled screw bolt 621 is screwed to the straight section 622 and locked by a nut 64, the other right angled screw bolt passes through the bottom end of the vertical bar of the first rail frame 52 and the connecting hole of the bottom end of the vertical bar of the second rail frame 54, and is locked by a but. The right angle screw comprises a small right angled screw bolt 621 and a straight section 622 connected by inner and outer screws.

A second embodiment of the guard rail is referred to in FIGS. 6-9, this embodiment differs from the first embodiment in that: the rotating mechanism comprises a rotating shaft 562 and a sleeve tube 564, the rotating shaft 562 and the sleeve tube 564 are respectively disposed at the first rail frame 52 and the second rail frame 54 and are rotatably connected in the axial direction in an insertion relationship. Therefore, the first rail frame 52 and the second rail frame 54 can rotate relatively in the axial direction, that is to say, in the horizontal plane. In addition, the guard rail further comprises a reinforcing mechanism, the reinforcing mechanism comprises a J shaped bolt 582 and a bolt hole 584, the bolt 582 and the bolt hole 584 are respectively disposed at the first rail frame 52 and the second rail frame 54, the bolt 582 is rotatably inserted into the bolt hole 584 when the first rail frame rotates about the axial direction.

Figure 10:
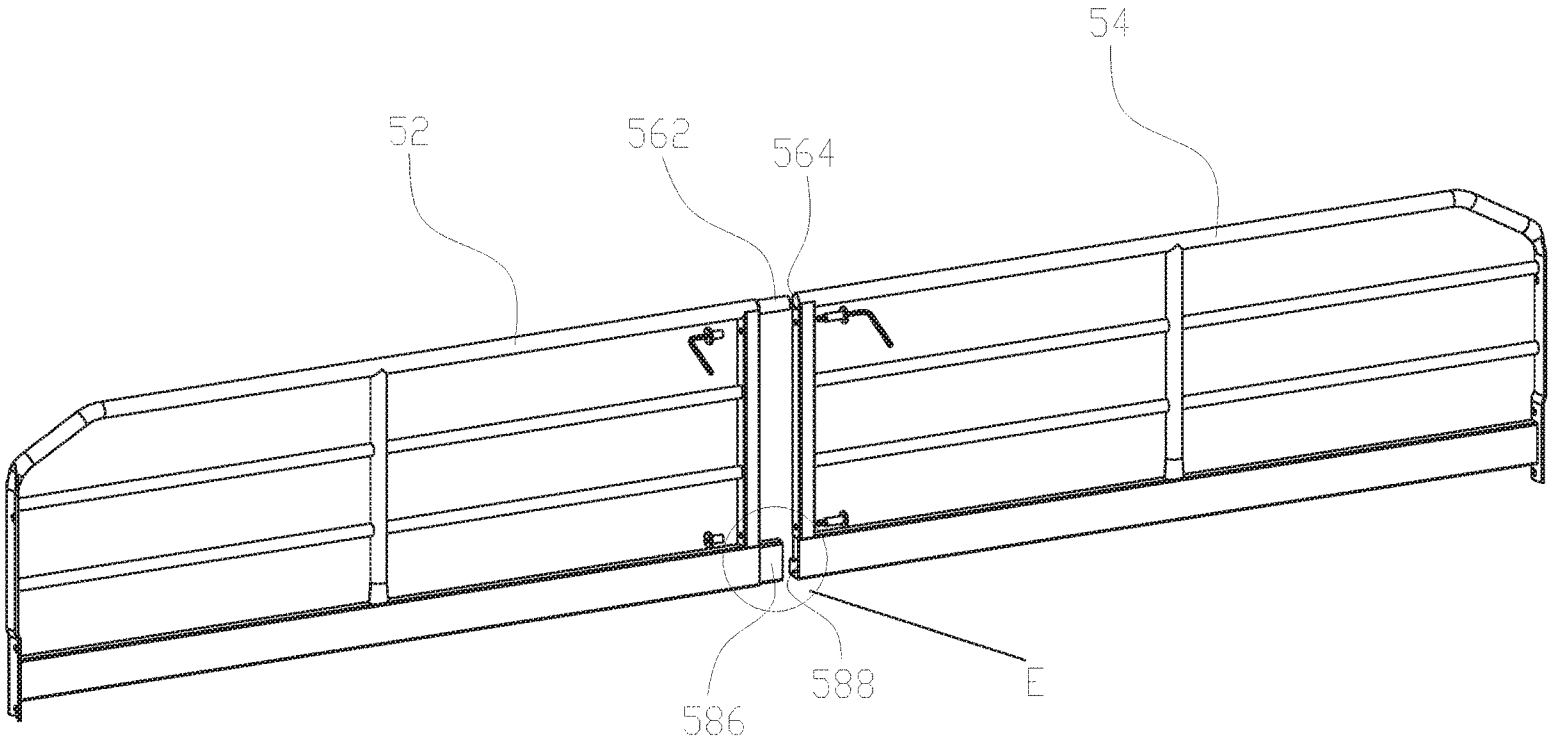
FIG. 10 illustrates an exploded schematic diagram of the guard rail of the bunk bed of FIG. 1 in a third embodiment.
Figure 11:
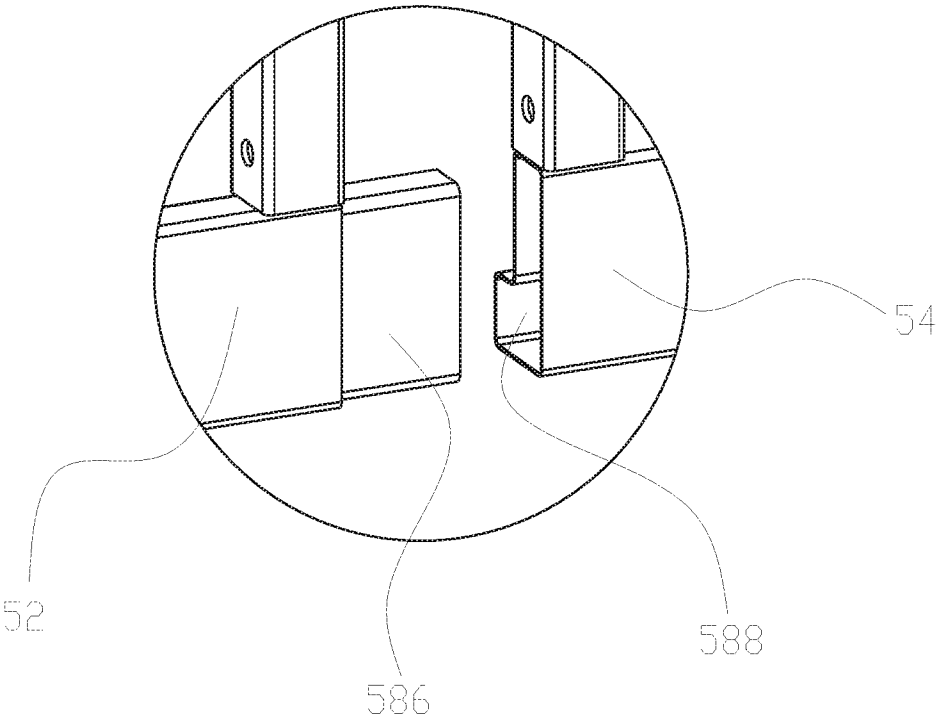
FIG. 11 illustrates an enlargement diagram of E of FIG. 10.

A third embodiment of the guard rail is referred to FIG. 10 and FIG. 11, this embodiment differs from the second embodiment in that the reinforcing mechanism comprises a tenon 586 and an insertion groove 588, the tenon 586 and the insertion groove 588 are respectively disposed at the first rail frame 52 and the second rail frame 54 and are rotatably connected in the axial direction in an insertion relationship.

Although the present invention has been described with reference to the preferred embodiments thereof for carrying out the invention, it is apparent to those skilled in the art that a variety of modifications and changes may be made without departing from the scope of the invention which is intended to be defined by the appended claims.

INDUSTRIAL APPLICABILITY

The present invention is provided that the guard rail of the bunk bed is detachable, the first rail frame and the second rail frame are movably connected, the first rail frame is locked to the second rail frame by a lock mechanism to form a complete detachable rail. The rail frames can be divided for package and transportation, thus increasing the container loading quantity.

What is claimed is:

1. A bunk bed equipped with a guard rail, comprising:

a bed board frame;

two side bed frames respectively disposed at a front side and a rear side of the bed board frame for supporting the bed board frame; and a guard rail disposed at a side of the bed board frame, the guard rail comprising a first rail frame, a second rail frame detachable from the first rail frame and a rotating mechanism, each of the first rail frame and the second rail frame having two parallel vertical bars and two parallel horizontal bars, the rotating mechanism connecting the first rail frame and the second rail frame, the first rail frame and the second rail frame being configured to rotate about a horizontal axis defined by one of the horizontal bars or a vertical axis parallel to the vertical bars, the first rail frame being locked to the second rail frame by a lock mechanism to form the guard rail.

2. The bunk bed equipped with a guard rail according to claim 1, wherein the lock mechanism comprises two bolts and two connecting holes respectively disposed at two neighboring vertical bars of the first rail frame and the second rail frame, a first bolt being used to lock an upper end of the first rail frame to an upper end of the second rail frame, a second bolt used to lock a bottom end of the first rail frame to a bottom end of the second rail frame.

3. The bunk bed equipped with a guard rail according to claim 2, wherein the rotating mechanism comprises at least one hinge.

4. The bunk bed equipped with a guard rail according to claim 1, wherein the rotating mechanism comprises a rotating shaft and a sleeve tube, the rotating shaft and the sleeve tube being respectively disposed at the first rail frame and the second rail frame and being rotatably connected along the horizontal axis in an insertion relationship.

5. The bunk bed equipped with a guard rail according to claim 4, wherein the guard rail further comprises a reinforcing mechanism, the reinforcing mechanism comprises a tenon and an insertion groove, the tenon and the insertion groove respectively disposed at the first rail frame and the second rail frame.

6. The bunk bed equipped with a guard rail according to claim 4, wherein the guard rail further comprises a reinforcing mechanism, the reinforcing mechanism comprises a J shaped bolt and a bolt hole, the bolt and the bolt hole respectively disposed at the first rail frame and the second rail frame, the bolt rotatably inserted in the bolt hole.

7. The bunk bed equipped with a guard rail according to claim 1, further comprising a ladder, a top end of the ladder being connected to the bed board frame.

8. The bunk bed equipped with a guard rail according to claim 7, further comprising a bed base frame, the side bed frames supporting the bed base frame, a bottom end of the ladder being connected to the bed base frame.

9. The bunk bed equipped with a guard rail according to claim 1, wherein the rotating mechanism comprises at least one hinge.

* * * * *